US008608945B2

(12) United States Patent
Bhattacharyya et al.

(10) Patent No.: US 8,608,945 B2
(45) **Date of Patent: *Dec. 17, 2013**

(54) PROCESS FOR USING SUPPORTED MOLYBDENUM CATALYST FOR SLURRY HYDROCRACKING

(75) Inventors: Alakananda Bhattacharyya, Glen Ellyn, IL (US); Beckay J. Mezza, Arlington Heights, IL (US); Maureen L. Bricker, Buffalo Grove, IL (US); Lorenz J. Bauer, Schaumburg, IL (US)

(73) Assignee: UOP LLC, Des Plaines, IL (US)

( * ) Notice: Subject to any disclaimer, the term of this patent is extended or adjusted under 35 U.S.C. 154(b) by 389 days.

This patent is subject to a terminal disclaimer.

(21) Appl. No.: 12/813,020

(22) Filed: Jun. 10, 2010

(65) Prior Publication Data

US 2011/0303583 A1 Dec. 15, 2011

(51) Int. Cl.

| | |
|---|---|
| ***C10G 47/12*** | (2006.01) |
| ***C10G 47/26*** | (2006.01) |
| ***C10G 47/00*** | (2006.01) |
| ***C10G 47/02*** | (2006.01) |

(52) U.S. Cl.
USPC ..... 208/112; 208/106; 208/107; 208/108; 502/305; 502/321

(58) Field of Classification Search
USPC ..... 208/112, 48 R, 106, 107, 108, 113, 121; 502/305, 321
See application file for complete search history.

(56) References Cited

U.S. PATENT DOCUMENTS

| | | | |
|---|---|---|---|
| 4,119,531 | A | 10/1978 | Hopkins et al. |
| 4,176,051 | A | 11/1979 | Ternan et al. |
| 4,446,008 | A | 5/1984 | Shimakawa et al. |
| 4,499,202 | A | 2/1985 | Arias et al. |
| 4,508,616 | A | 4/1985 | Larrauri et al. |
| 4,525,267 | A | 6/1985 | Inooka |
| 4,632,914 | A | 12/1986 | Arias et al. |
| 4,655,903 | A | 4/1987 | Rahbe et al. |
| 4,969,988 | A | 11/1990 | Jain et al. |
| 5,207,893 | A | 5/1993 | Iwamoto et al. |
| 5,466,363 | A | 11/1995 | Audeh et al. |
| 5,755,955 | A | 5/1998 | Benham et al. |
| 5,811,608 | A | 9/1998 | Stine et al. |
| 5,954,945 | A | 9/1999 | Cayton et al. |
| 6,042,719 | A | 3/2000 | Shih |
| 6,071,402 | A | 6/2000 | Danot et al. |

(Continued)

FOREIGN PATENT DOCUMENTS

| | | | |
|---|---|---|---|
| JP | 04363142 | A | 12/1992 |

OTHER PUBLICATIONS

Howe, et al., Properties of Diaspore, Bauxite, and Gibbsite, 1923, Journal of the American Ceramic Society, vol. 6, Issue 3, pp. 496-500.*

(Continued)

*Primary Examiner* — Walter D Griffin
*Assistant Examiner* — Derek Mueller
(74) *Attorney, Agent, or Firm* — James C Paschall

(57) ABSTRACT

A process is disclosed for converting heavy hydrocarbon feed into lighter hydrocarbon products. The heavy hydrocarbon feed is slurried with a catalyst comprising molybdenum supported on a base, such as boehmite or pseudo-boehmite alumina. Iron oxide may also be in the base. The base is preferably bauxite. The heavy hydrocarbon slurry is hydrocracked in the presence of the catalyst to produce lighter hydrocarbons.

7 Claims, 1 Drawing Sheet

(56) References Cited

U.S. PATENT DOCUMENTS

| | | | |
|---|---|---|---|
| 6,299,760 | B1 | 10/2001 | Soled et al. |
| 6,712,955 | B1 | 3/2004 | Hou et al. |
| 7,538,066 | B2 | 5/2009 | Soled et al. |
| 2005/0101480 | A1 | 5/2005 | Ackerman et al. |
| 2007/0123416 | A1 | 5/2007 | Mayoral et al. |
| 2008/0149531 | A1 | 6/2008 | Roy-Auberger et al. |
| 2011/0000820 | A1 | 1/2011 | Bhattacharyya et al. |

OTHER PUBLICATIONS

U.S. Appl. No. 12/813,043, filed Jun. 10, 2010, Bhattacharyya et al.
U.S. Appl. No. 12/813,060, filed Jun. 10, 2010, Bhattacharyya et al.
Duan, A. et al., Characterization and activity of Mo supported catalysts for diesel deep hydrodesulphurization, Catalysis Today, 119, p. 13-18, 2007.
Inamura et al., Preparation of active HDS catalysts by controlling the dispersion of active species, Applied Surface Science, v 121-122, p. 468-475, 1997.
Vazquez et al., Influence of support on concentration profiles in alumina pellets impregnated with molybdenum solutions, Intl Communications in Heat, v 20, p. 631, 1993.
Monnier et al., Catalysts for hydroprocessing mixtures of heavy oil and coal, Ind. Eng. Chem. Prod. Res. Dev. V25 N4 p. 537-41, Amer. Chem. Soc., 1986.
Escobar et al., Highly active sulfided CoMo catalyst on nano-structured TiO2, Catalysis today 106, p. 222-226, Intl Conference on Gas-Fuel 05, 2005.
Huo et al., The role of H2S in reduction of Mo03/Al203 (catalysts), Reaction Kinetics and Catalysis Letters, V43, p. 25-29, Kluwer Academic Publishers, 1991.
Milburn et al., Colloidal coal hydroliquefaction. Catalyst Preparation. 198th ACS Natl. Meet, Miami Beach, ACS Div. Fuel Chem Prep. V34 p. 1439-45, 1989.

* cited by examiner

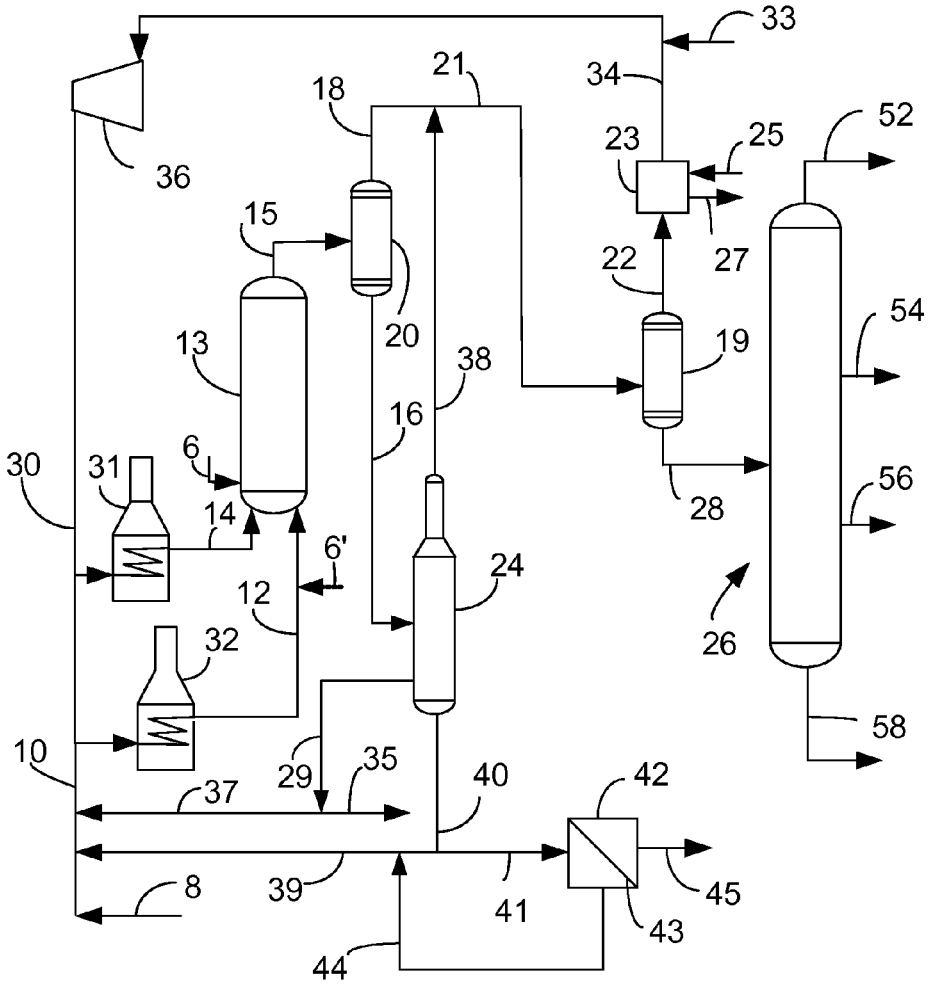
33
34
21
18
36
23
25
52
15
22
27
20
54
13
38
19
16
6
30
31
28
56
14
6'
24
12
26
32
58
10
29
35
40
42
37
39
41
45
8
43
44

PROCESS FOR USING SUPPORTED MOLYBDENUM CATALYST FOR SLURRY HYDROCRACKING

BACKGROUND OF THE INVENTION

This invention relates to a process for the treatment of crude oils and, more particularly, to the hydroconversion of heavy hydrocarbons in the presence of additives and catalysts to provide useable products and further prepare feedstock for further refining.

As the reserves of conventional crude oils decline, heavy oils must be upgraded to meet world demands. In heavy oil upgrading, heavier materials are converted to lighter fractions and most of the sulfur, nitrogen and metals must be removed. Heavy oils include materials such as petroleum crude oil, atmospheric tower bottoms products, vacuum tower bottoms products, heavy cycle oils, shale oils, coal derived liquids, crude oil residuum, topped crude oils and the heavy bituminous oils extracted from oil sands. These heavy hydrocarbon feedstocks may be characterized by low reactivity in visbreaking, high coking tendency, poor susceptibility to hydrocracking and difficulties in distillation. Most residual oil feedstocks which are to be upgraded contain some level of asphaltenes which are typically understood to be heptane insoluble compounds as determined by ASTM D3279 or ASTM D6560. Asphaltenes are high molecular weight compounds containing heteroatoms which impart polarity.

Heavy oils must be upgraded in a primary upgrading unit before it can be further processed into useable products. Primary upgrading units known in the art include, but are not restricted to, coking processes, such as delayed or fluidized coking, and hydrogen addition processes such as ebullated bed or slurry hydrocracking (SHC). As an example, the yield of liquid products, at room temperature, from the coking of some Canadian bitumens is typically about 55 to 60 wt-% with substantial amounts of coke as by-product. On similar feeds, ebullated bed hydrocracking typically produces liquid yields of 50 to 55 wt-%. U.S. Pat. No. 5,755,955 describes an SHC process which has been found to provide liquid yields of 75 to 80 wt-% with much reduced coke formation through the use of additives.

In SHC, a three-phase mixture of heavy liquid oil feed cracks in the presence of gaseous hydrogen over solid catalyst to produce lighter products under pressure at an elevated temperature. Iron sulfate has been disclosed as an SHC catalyst, for example, in U.S. Pat. No. 5,755,955.

Some reported SHC catalysts employ molybdenum as the active species. Molybdenum has been shown to have a stronger hydrogenation function compared to iron. However, molybdenum is more expensive than iron. Moreover, even at the very low concentrations in parts per million required for sufficient conversion, molybdenum catalysts may need to be recoverable to be cost effective. Such low concentrations of molybdenum are difficult to reclaim as they are highly diluted in the product streams.

During an SHC reaction, it is important to minimize coking. Asphaltenes present as a byproduct from the SHC reaction product can, if not managed properly, self-associate, or flocculate to form larger molecules, generate a mesophase and precipitate out of solution to form coke. Mesophase formation is a critical reaction constraint in SHC reactions.

DEFINITIONS

The following definitions shall be applicable throughout this document.

As used herein, the term "base" with reference to a "catalyst" is a material substrate which is the largest proportion of the catalyst and which maintains a solid state structure when an active material such as a metal is loaded, dispersed and/or supported on the base.

As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, "pitch" means the hydrocarbon material boiling above about 524° C. (975° F.) AEBP as determined by any standard gas chromatographic simulated distillation method such as ASTM D2887, D6352 or D7169, all of which are used by the petroleum industry.

As used herein, "pitch conversion" is the weight ratio of material boiling at or below 524° C. (975° F.) in the product relative to the material boiling above 524° C. in the feed.

As used herein, "heavy gas oil" (HGO) means the hydrocarbon material boiling in the range between about 343° C. (650° F.) and about 524° C. (975° F.).

As used herein, "light gas oil" (LGO) means the hydrocarbon material boiling in the range between about 204° C. (400° F.) and about 343° C. (650° F.).

As used herein, "heavy vacuum gas oil" (HVGO) means the hydrocarbon material boiling in the range between about 427° C. (800° F.) and about 524° C. (975° F.).

As used herein, "light vacuum gas oil" (LVGO) means the hydrocarbon material boiling in the range between about 343° C. (650° F.) and about 427° C. (800° F.).

As used herein, solvent "insolubles" means materials not dissolving in the solvent named.

As used herein, "TIOR" is the toluene-insoluble organic residue which represents non-catalytic solids in the product part boiling over 524° C.

As used herein, "mesophase" is a component of TIOR that signifies the existence of coke, another component of TIOR. Mesophase is a semi-crystalline carbonaceous material defined as round, anisotropic particles present in pitch. The presence of mesophase can serve as a warning that operating conditions are too severe in an SHC and that coke formation is likely to occur under prevailing conditions.

As used herein, the concentration of metal such as molybdenum, iron or alumina in the hydrocarbon is the weight ratio of metal in bulk or on the catalyst relative to the total material charged to the SHC reactor for a batch reactor and relative to the non-gas materials in the SHC reactor for a continuous reactor. The non-gas materials in the reactor are typically the hydrocarbon liquids and solids and the catalyst and do not include reactor and ancillary equipment.

As used herein, "mean particle or crystallite diameter" is understood to mean the same as the average particle or crystallite diameter and is calculated for all of the particles or crystallites fed to the reactor which may be determined by a representative sampling, respectively.

SUMMARY OF THE INVENTION

In an SHC process, we have found that a molybdenum supported on alumina catalyst can provide good pitch conversion and suppress mesophase formation.

In a process embodiment, the invention comprises a process for converting heavy hydrocarbon feed into lighter hydrocarbon products comprising: mixing heavy hydrocarbon liquid feed with hydrogen and catalyst particles comprising molybdenum supported on a base comprising boehmite or pseudo-boehmite alumina to form a heavy hydrocarbon slurry. Hydrocarbons are hydrocracked in the heavy hydrocarbon slurry in the presence of hydrogen in a hydrocracking reactor to produce a hydrocracked slurry product comprising lighter hydrocarbon products. Lastly the hydrocracked slurry product is withdrawn from the hydrocracking reactor.

In an additional process embodiment, the catalyst particles comprise molybdenum supported on a base comprising alumina and iron oxide.

In a further process embodiment, the catalyst particles comprising molybdenum supported on a base comprising bauxite.

BRIEF DESCRIPTION OF THE DRAWING

For a better understanding of the invention, reference is made to the accompanying drawing. The FIGURE is a schematic flow scheme for an SHC plant.

DESCRIPTION OF THE PREFERRED EMBODIMENTS

The catalyst of the present invention is molybdenum impregnated onto a base. The base may be an ore or mineral or waste product or a manufactured form of alumina. The alumina may be in a particle size range suitable for SHC operations and post SHC recovery for recycle. An alumina base may provide a substrate for the molybdenum as well as offering the coke suppression capability. Molybdenum supported on alumina provides equivalent activity to iron based catalyst at lower concentration in hydrocarbon while offering the ability to recover and recycle molybdenum. Alternatively the molybdenum supported catalyst could be used at higher molybdenum concentration to provide enhanced hydrogenation activity. Molybdenum on alumina catalyst could be provided to increase coke suppression.

The current iron based catalysts for SHC of heavy oil have lower hydrogenation activity than molybdenum based catalysts. Experiments show that 300 wppm of molybdenum in hydrocarbon is roughly equivalent to 0.66% iron from bauxite or 2% iron from ferrous sulfate. Molybdenum impregnated onto alumina and charged to the reaction at a 300 wppm concentration in hydrocarbon provided equivalent activity to an iron catalyst while greatly lowering the amount of solids circulating through the reactor. The base would provide bulk to the molybdenum catalyst allowing more facile recycle or recovery. Alumina in the base greatly suppresses formation of mesophase which leads to coke.

Molybdenum is an expensive metal and when used in ppm quantities as a bulk metal slurry catalyst, recovery is not efficient. Sustainable molybdenum management would improve the economics associated with using molybdenum catalyst. Higher molybdenum concentration with its increased hydrogenation could alter the process dynamics toward less severe operating conditions and less coke formation. Currently SHC reactions are thermal in nature with coke suppression being the target of the catalyst. A catalyst with a stronger hydrogenation function, such as a higher loading of molybdenum, might allow equivalent activity at less severe operating conditions. Here we report an easily recyclable SHC catalyst which has the potential to improve hydrogenation, while also reducing the cost of what is known to be a more active catalyst. In addition this catalyst will offer the added advantage of coke suppression which was observed when loaded on a bauxite support.

The process of this invention is capable of processing a wide range of heavy hydrocarbon feedstocks. It can process aromatic feedstocks, as well as feedstocks which have traditionally been very difficult to hydroprocess, e.g. vacuum bottoms, visbroken vacuum residue, deasphalted bottom materials, off-specification asphalt, sediment from the bottom of oil storage tanks, etc. Suitable feeds include atmospheric residue boiling at about 650° F. (343° C.), HVGO boiling at about 800° F. (427° C.) and vacuum residue boiling above about 950° F. (510° C.). Feeds of which 90 wt-% boils at a temperature greater than or equal to 572° F. (300° C.) will be suitable. Suitable feeds include an API gravity of no more than 20 degrees, typically no more than 10 degrees and may include feeds with less than 5 degrees.

In the exemplary SHC process as shown in the FIGURE, one, two or all of a heavy hydrocarbon oil feed in line 8, a recycle pitch stream containing catalyst particles in line 39, and recycled HVGO in line 37 may be combined in line 10. The combined feed in line 10 is heated in the heater 32 and pumped through an inlet line 12 into an inlet in the bottom of the tubular SHC reactor 13. Solid particulate catalyst material may be added directly to heavy hydrocarbon oil feed in the SHC reactor 13 from line 6 or may be mixed from line 6' with a heavy hydrocarbon oil feed in line 12 before entering the reactor 13 to form a slurry in the reactor 13. It is not necessary and may be disadvantageous to add the catalyst upstream of the heater 32. It is possible that in the heater, catalyst particles may sinter or agglomerate to make larger catalyst particles, which is to be avoided. Many mixing and pumping arrangements may be suitable. It is also contemplated that feed streams may be added separately to the SHC reactor 13. Recycled hydrogen and make up hydrogen from line 30 are fed into the SHC reactor 13 through line 14 after undergoing heating in heater 31. The hydrogen in line 14 that is not premixed with feed may be added at a location above the feed entry in line 12. Both feed from line 12 and hydrogen in line 14 may be distributed in the SHC reactor 13 with an appropriate distributor. Additionally, hydrogen may be added to the feed in line 10 before it is heated in heater 32 and delivered to the SHC reactor in line 12. Preferably the recycled pitch stream in line 39 makes up in the range of about 5 to about 15 wt-% of the feedstock to the SHC reactor 13, while the HVGO in line 37 makes up in the range of 5 to 50 wt-% of the feedstock, depending upon the quality of the feedstock and the once-through conversion level. The feed entering the SHC reactor 13 comprises three phases, solid catalyst particles, vaporous, liquid and solid hydrocarbon feed and gaseous hydrogen.

The process of this invention can be operated at quite moderate pressure, in the range of 500 to 3500 psi (3.5 to 24 MPa) and preferably in the range of 1500 to 2500 psi (10.3 to 17.2 MPa), without coke formation in the SHC reactor 13. The reactor temperature is typically in the range of about 400 to about 500° C. with a temperature of about 440 to about 465° C. being suitable and a range of 445° to 460° C. being preferred. The LHSV is typically below about 4 $h^{-1}$ on a fresh feed basis, with a range of about 0.1 to 3 $h^{-1}$ being preferred and a range of about 0.3 to 1 $h^{-1}$ being particularly preferred. Although SHC can be carried out in a variety of known reactors of either up or downflow, it is particularly well suited to a tubular reactor through which feed, catalyst and gas move upwardly. Hence, the outlet from SHC reactor 13 is above the inlet. Although only one is shown in the FIGURE, one or more SHC reactors 13 may be utilized in parallel or in series.

Because the liquid feed is converted to vaporous product, foaming tends to occur in the SHC reactor 13. An antifoaming agent may also be added to the SHC reactor 13, preferably to the top thereof, to reduce the tendency to generate foam. Suitable antifoaming agents include silicones as disclosed in U.S. Pat. No. 4,969,988.

A gas-liquid mixture is withdrawn from the top of the SHC reactor 13 through line 15 and separated preferably in a hot, high-pressure separator 20 kept at a separation temperature between about 200° and 470° C. (392° and 878° F.) and preferably at about the pressure of the SHC reactor. In the hot separator 20, the effluent from the SHC reactor 13 is separated into a liquid stream 16 and a gaseous stream 18. The liquid stream 16 contains HVGO. The gaseous stream 18 comprises between about 35 and 80 vol-% of the hydrocarbon product from the SHC reactor 13 and is further processed to recover hydrocarbons and hydrogen for recycle.

A liquid portion of the product from the hot separator 20 may be used to form the recycle stream to the SHC reactor 13 after separation which may occur in a liquid vacuum fractionation column 24. Line 16 introduces the liquid fraction from the hot high pressure separator 20 preferably to a vacuum distillation column 24 maintained at a pressure between about 0.25 and 1.5 psi (1.7 and 10.0 kPa) and at a vacuum distillation temperature resulting in an atmospheric equivalent cut point between LVGO and HVGO of between about 250° and 500° C. (482° and 932° F.). Three fractions may be separated in the liquid fractionation column: an overhead fraction of LVGO in an overhead line 38 which may be further processed, a HVGO stream from a side cut in line 29 and a pitch stream obtained in a bottoms line 40 which typically boils above 450° C. At least a portion of this pitch stream may be recycled back in line 39 to form part of the feed slurry to the SHC reactor 13. Remaining catalyst particles from SHC reactor 13 will be present in the pitch stream in line 41.

A filtration device 42 such as a centrifuge, a sieve device or other suitable means may separate catalyst particles from pitch at temperature of about 250° to about 350° C. A sieve device is illustrated as the filtration device 42. In the filtration device 42 catalyst particles do not permeate a sieve 43 but are returned in line 44 to the recycle pitch line 39 to reenter the reactor with the recycled pitch. Filtered pitch with very little catalyst loading is removed from the filtration device 42 in line 45. Any remaining portion of the pitch stream is recovered in line 41.

During the SHC reaction, it is important to minimize coking. Adding a low-polarity aromatic oil to the feedstock reduces coke production. The polar aromatic material may come from a wide variety of sources. A portion of the HVGO containing polar aromatic material in line 29 may be recycled by line 37 to form part of the feed slurry to the SHC reactor 13. The remaining portion of the HVGO may be recovered in line 35.

The gaseous stream in line 18 may be combined with the overhead fraction of LVGO from the overhead line 38 and may be delivered to a cool, high pressure separator 19. Within the cool separator 19, the product is separated into a gaseous stream rich in hydrogen which is drawn off through the overhead in line 22 and a liquid hydrocarbon product which is drawn off the bottom through line 28. The hydrogen-rich stream 22 may be passed through a packed scrubbing tower 23 where it is scrubbed by means of a scrubbing liquid in line 25 to remove hydrogen sulfide and ammonia. The spent scrubbing liquid in line 27 may be regenerated and recycled and is usually an amine. The scrubbed hydrogen-rich stream emerges from the scrubber via line 34 and is combined with fresh make-up hydrogen added through line 33 and recycled through a recycle gas compressor 36 and line 30 back to reactor 13. The bottoms line 28 may carry liquid SHC product to a product fractionator 26.

The product fractionator 26 may comprise one or several vessels although it is shown only as one in the FIGURE. The product fractionator produces a $C_4^-$ stream recovered in overhead line 52, a naphtha product stream in line 54, a diesel stream in line 56 and a light vacuum gas oil (LVGO) stream in bottoms line 58.

We have discovered that molybdenum supported on a base can be an effective SHC catalyst. Molybdenum supported catalysts can be recovered in SHC effluent and recycled to the SHC reactor with equivalent or better conversion of pitch. We have also found that molybdenum supported catalyst can be an effective SHC catalyst at lower metal loadings than required for conventional SHC catalysts. Molybdenum may be the sole metal supported on the base and be an effective SHC catalyst. In an aspect, no more than about 15 wt-% total metal may be loaded on the base and, preferably, no more than about 7 wt-% metal may be loaded on the base. In a further aspect, no more than about 6 wt-% molybdenum is loaded on the base. However, higher molybdenum and metal loadings may be utilized.

We have also found that molybdenum supported on a base can be an effective SHC catalyst at lower metal concentrations in hydrocarbon than experienced in SHC and in other hydroprocessing applications. We have found that the molybdenum may have a concentration in hydrocarbon of less than 1000 wppm and achieve desirable pitch conversion. In an aspect, the concentration of molybdenum in the hydrocarbon may be no more than 600 wppm and achieve desirable pitch conversion. In an additional aspect, the concentration of molybdenum in the hydrocarbon may be no less than about 100 wppm and no more than about 600 wppm and achieve desirable pitch conversion. In a further aspect, the concentration of molybdenum in the hydrocarbon may be no less than about 5 wppm and preferably no less than about 25 wppm and achieve desirable pitch conversion.

Many types of catalyst bases will be adequate to support the molybdenum. Silica, silica-alumina, titania, zeolites, clays and mixtures thereof may be suitable bases for supporting molybdenum. However, we have found that an alumina base is a suitable base for molybdenum.

The alumina in the base can be in several forms including amorphous, alpha, gamma, theta, boehmite, pseudo-boehmite, gibbsite, diaspore, bayerite, nordstrandite and corundum. However, it is preferred that the alumina be in a hydrated phase with about a 1:1 molecular ratio of water to alumina such as in boehmite or pseudo-boehmite with a formula AlO(OH). Alumina can be provided in the catalyst by derivatives such as spinels and perovskites. Aluminas with higher molecular ratios of water to alumina are believed to enter a boehmite or pseudo-boehmite phase upon heating in the SHC reactor 13.

We have also found that an iron component in conjunction with the alumina component in the base supporting the molybdenum substantially retards the formation of mesophase. For example, a molybdenum-supporting base comprising about 2 to about 45 wt-% iron oxide and about 20 to about 98 wt-% alumina on a non-volatile basis can reduce mesophase formation to nil.

Bauxite is a preferred bulk available mineral having these proportions. Bauxite typically has about 10 to about 40 wt-% iron oxide, $Fe_2O_3$, and about 54 to about 84 wt-% alumina and may have about 10 to about 35 wt-% iron oxide and about 55 to about 80 wt-% alumina. Bauxite also may comprise silica, and titania in aggregate amounts of usually no more than 10 wt-% and typically in aggregate amounts of no more than 6 wt-%. Aluminum is present in bauxite as alumina, typically in the boehmite or pseudo-boehmite phase. Iron is present in bauxite as iron oxide. The iron oxide may be hematite, $Fe_2O_3$, or magnetite, $Fe_3O_4$ and may also be in a hydrated form. Suitable bauxite is available from Saint-Gobain Norpro in Stow, Ohio which may provide it air dried and ground, but these treatments may not be necessary for suitable performance as a catalyst base for SHC. Other minerals that contain iron oxide and alumina such as limonite and laterite may be suitable bases for molybdenum support.

Volatiles such as water and carbon dioxide are also present in bulk available minerals, but the foregoing weight proportions exclude the volatiles. The foregoing proportions exclude the water in the hydrated composition.

Bauxite can be mined and ground to particles having a mean particle diameter of 0.1 to 5 microns. The particle diameter is the length of the largest orthogonal axis through the particle. We have found that alumina and iron oxide catalyst with mean particle diameters of no less than 200 microns, using the dry method to determine particle diameter, exhibit performance comparable to the performance of the same catalyst ground down to the 0.1 to 5 micron range. Hence, alumina and iron oxide base with mean particle diameters of no less than 200 microns and preferably no less than 250 microns may be used to support molybdenum in SHC reactions. In an embodiment, the catalyst base may not exceed about 600 microns in terms of mean particle diameter using the dry method to determine particle diameter.

The supported molybdenum catalyst may be prepared by impregnating ammonium heptamolybdate, or any soluble form of molybdenum onto the base, followed by overnight drying. If the base is to be ground to smaller size, it should be done before loading the metal. Metal may alternatively be loaded on the base support by physically mixing a molybdenum compound such as molybdenum oxide and the support followed by calcination, by molybdenum deposition, comulling, or comilling followed by calcination. Calcination should follow physical mixing and comilling loading techniques, so the molybdenum sinters with the metal in the support to effect loading. However, if hydrated alumina is in the base, calcination should not exceed 450° C. to avoid driving off the water which will take it out of the boehmite or pseudo-boehmite form. The supported catalyst may suitably have about 0.1 to about 15 wt-% molybdenum and preferably about 1 to about 6 wt-% molybdenum.

The molybdenum particles have not registered a peak in X-ray diffraction analysis, which probably means that the molybdenum particle size is submicron.

The catalyst may be mixed with the hydrocarbon feed at an elevated temperature to ensure good dispersion. The slurry of catalyst and hydrocarbon feed may be heated and held at the appropriate reaction conditions. The molybdenum catalyst is sulfided in-situ by $H_2S$ generated from the sulfur in the feed to obtain $MoS_2$, which is the active form of the catalyst.

Iron concentration of catalyst in an SHC reactor may be about 0.1 to about 4.0 wt-% and usually no more than 2.0 wt-% of the hydrocarbon in the SHC reactor. A suitable aluminum concentration in the catalyst base is about 0.1 to about 20 wt-% relative to the hydrocarbon in the reactor. An aluminum concentration of no more than 10 wt-% may be preferred.

EXAMPLES

Example 1

A solution of 25.15 g water and 0.39 g ammonium molybdate tetrahydrate ($(NH_4)_6Mo_7O_{24}.4H_2O$) was made. To this solution, 20.61 g Catapal alumina was added. The mixture became a thick paste. Not all of the Catapal alumina was wetted so 36.55 g water was added until everything was wet. The paste was left in a beaker overnight in an oven at 150° C. and stirred occasionally to break up solids to provide 18.52 g of powdered solids comprising 1.07 wt-% molybdenum on Catapal alumina.

Example 2

A solution of 0.4681 g ammonium molybdate tetrahydrate dissolved in 72.73 g water was made. To the solution 25.00 grams of bauxite was added. The bauxite comprised 67.55 wt-% boehmite alumina, AlO(OH), 23.4 wt-% iron oxide in hematite form, $Fe_2O_3$, and 2.9 wt-% in anatase form, $TiO_2$. The bauxite had a mean diameter of 1.01 according to wet measure and 4.91 measured by the dry measure.

The mixture was dried overnight with no stirring at 135° C. to produce 24.5 g solids in a cake comprising 1 wt-% molybdenum on bauxite. A catalyst comprising 15.9 wt-% iron, 0.95 wt-% molybdenum and 30.1 wt-% aluminum and a loss on ignition of 6.9 was made.

Example 3

Sufficient water was added to dissolve 18.72 g of ammonium heptamolybdate. The solution was combined with 100 g of bauxite. The resulting material was dried in a convection oven at 135° C. until free flowing. A catalyst comprising 16.1 wt-% iron, 10.7 wt-% molybdenum, 30.6 wt-% aluminum and a loss on ignition of 6.9 was produced.

Pilot plant experiments have been carried out to demonstrate the feasibility of using supported molybdenum as an improvement to the standard iron sulfate catalyst for SHC. The batch autoclave test used a 1-liter stainless steel stirred autoclave reactor. In a typical experiment, 334 grams of vacuum resid characterized in Table 1 was combined with the molybdenum catalyst. The molybdenum on the support was expected to convert to the active form of molybdenum sulfide supplied by sulfur in the feed. Typically, the autoclave was heated to about 460° C. at 13790 kPa (g) (2000 psig) hydrogen and hydrogen was continuously added through a sparger and passed through the reactor at a rate of 6.5 standard liters per minute. The reaction time was variable but limited to a maximum of 80 minutes. The flowing hydrogen strips out the light products which were trapped in knock-out pots. The products in the reactor, the knock-out pots and the gas were analyzed and pitch conversion and product yields were calculated.

TABLE 1

| Test | Vacuum Bottoms 524° C. (975° F.+) |
|---|---|
| Specific Gravity, g/cc | 1.03750 |
| API gravity | −0.7 |
| ICP Metals | |
| Ni, wt. ppm | 143 |
| V, wt. ppm | 383 |
| Fe, wt. ppm | 68.8 |
| Microcarbon residue, wt-% | 25.5 |
| C, wt-% | 80.3 |
| H, wt-% | 9.0 |
| N, wt-% | 0.4 |
| Total N, wt. ppm | 5744 |
| Oxygen, wt-% in organics | 0.78 |
| Sulfur, wt-% | 7 |
| Ash, wt-% | 0.105 |

TABLE 1-continued

| Test | Vacuum Bottoms 524° C. (975° F.+) |
|---|---|
| Heptane insolubles, wt-% | 16.1 |
| Pentane insolubles, wt-% | 24.9 |
| Total chloride, mass ppm | 124 |
| Saybolt viscosity, Cst 150° C. | 1400 |
| Saybolt viscosity, Cst 177° C. | 410 |

"ICP" stands for Inductively Coupled Plasma Atomic Emissions Spectroscopy, which is a method for determining metals content.

Example 4

The catalysts of Examples 1 and 2 were compared to unsupported bulk molybdenum octanoate catalyst at a 300 ppm molybdenum concentration in the hydrocarbon. Catalysts were made from the catalyst of Example 2 supporting 0.05 wt-% molybdenum by adding 50 wt-% Catapal alumina. These materials were also compared at 150 ppm molybdenum concentration in the hydrocarbon The bauxite was charged to the reactor to have a 0.66 wt-% iron and 1 wt-% alumina concentration in the hydrocarbon, both when loaded with molybdenum and when not loaded with molybdenum. Results are shown in Table 2.

TABLE 2

| Run No. | 277 | 273 | 208 | 181 | 135 | 171 | 209 |
|---|---|---|---|---|---|---|---|
| Catalyst | Mo with no support | Mo on Catapal alumina | Mo on bauxite | Bauxite | Iron sulfate monohydrate | Mo with no support | Mo on Catapal alumina |
| Molybdenum concentration, ppm | 300 | 300 | 300 | 0 | 0 | 150 | 150 |
| Iron concentration, wt-% | 0 | 0 | 0.66 | 0.66 | 2 | 0 | 0 |
| Conversion, wt % pitch & TIOR | 88.25 | 88.81 | 87.73 | 87.52 | 84.08 | 86.51 | 87.07 |
| Naphtha (C. 5-204° C.) yield, wt-% feed | 29.97 | 30.12 | 28.49 | 27.42 | 28.02 | 32.63 | 29.51 |
| LGO (204 C.-343° C.) yield, wt-% feed | 23.33 | 24.63 | 24.60 | 25.92 | 26.92 | 23.35 | 24.66 |
| HGO (343 C.-524° C.) yield, wt-% feed | 15.08 | 15.78 | 15.35 | 15.07 | 14.25 | 13.39 | 15.18 |
| Pitch (524° C.+) yield, wt-% feed | 10.63 | 10.13 | 11.10 | 11.29 | 14.23 | 12.02 | 11.70 |
| TIOR, wt-% | 2.44 | 2.48 | 2.70 | 2.34 | 5.46 | 2.90 | 2.20 |
| XRD Mesophase, wt-% | 12.50 | 4.45 | 0.00 | 0.40 | 6.26 | 21.62 | 5.07 |

Results in Table 2 show that the product yields and conversion for supported molybdenum were equal to unsupported molybdenum tested at the same concentrations. Supported molybdenum at 300 and 150 wppm had yields and conversion superior to the iron sulfate monohydrate catalyst concentrated at 2 wt-% in the hydrocarbon. Supported molybdenum at 300 wppm had yield and conversion superior to the bauxite, whereas at 150 wppm concentration in the hydrocarbon, supported molybdenum was equivalent to bauxite.

Mesophase formation was reduced by the molybdenum catalyst supported on alumina and eliminated by molybdenum supported on bauxite. Mesophase formation is a predictor of coke formation. No loss of activity was observed with the supported molybdenum catalyst and alumina is observed to suppress coke formation in SHC experiments.

Example 5

One weight percent molybdenum-supported catalyst of Example 2 used in run 208 from Example 4 was collected at the end of the experiment from the TIOR left in the reactor. Some of the recovered catalyst was sacrificed for compositional analysis. To make up for the lost catalyst, the recovered catalyst was supplemented with recycled 1 wt-% molybdenum on bauxite catalyst of Example 2 from another SHC run and tested in the SHC pilot plant where its performance was equivalent to unsupported, bulk molybdenum. No loss in activity was observed as results are shown in Table 3.

TABLE 3

| | Run No. | |
|---|---|---|
| Catalyst | 208 Mo on bauxite | 327 Recycled Mo on bauxite |
| Molybdenum concentration, ppm | 300 | 300 |
| Conversion, wt-% pitch & TIOR | 87.73 | 88.68 |
| Naphtha ($C_5$-204° C.) yield, wt-% feed | 28.49 | 30.85 |

TABLE 3-continued

| | Run No. | |
|---|---|---|
| Catalyst | 208 Mo on bauxite | 327 Recycled Mo on bauxite |
| LGO (204°-343° C.) yield, wt-% feed | 24.60 | 24.02 |
| HGO (343°-524° C.) yield, wt-% feed | 15.35 | 14.76 |
| Pitch (524° C.+) yield, wt-% feed | 11.10 | 10.24 |
| TIOR, wt-% | 2.70 | 2.41 |
| XRD Mesophase, wt-% | 0.00 | 0.00 |

When the catalyst was analyzed at the end of run 208, all of the catalyst including molybdenum and bauxite was recovered as shown in Table 4. After the recycle experiment 327, only 90 wt-% of the molybdenum was recovered after the recycle experiment, and the bauxite recovered was also reduced. However, the mass fraction of the molybdenum and the bauxite components recovered were proportional to the catalyst composition. Hence, the loss was likely due to experimental handling and the small scale of the samples.

TABLE 4

| | Run | |
|---|---|---|
| Recovery, % | 208 First | 327 Recycle |
| Alumina | ~100 | 88.5 |
| Iron | ~100 | 86.6 |
| Molybdenum | ~100 | 90.4 |

Example 6

Pilot plant experiments at 420° C. with 2 different molybdenum on bauxite loadings were compared. In the first experiment, 1 wt-% molybdenum of Example 2 was loaded onto a bauxite support and was combined with the feed to create a 300 wppm molybdenum concentration in the hydrocarbon. In the second experiment, 10 wt-% molybdenum of Example 3 was loaded onto a bauxite support and was combined with the feed to create a 3000 wppm molybdenum concentration in the hydrocarbon. The experiment was performed at 420° C. to shift the conversion toward catalytic conversion and away from the thermal cracking reactions observed at 460° C. At 420° C., 3000 wppm molybdenum showed a 10% increase in pitch conversion activity compared to the molybdenum supported catalyst at 300 wppm in the hydrocarbon. This data is shown in Table 5.

TABLE 5

| | Run No. | |
|---|---|---|
| Catalyst | 300 Mo on bauxite | 328 Mo on bauxite |
| Molybdenum concentration, ppm | 300 | 3000 |
| Conversion, wt-% pitch & TIOR | 57.99 | 69.82 |
| Naphtha ($C_5$-204° C.) yield, wt-% feed | 8.47 | 9.11 |
| LGO (204°-343° C.) yield, wt-% feed | 15.87 | 28.65 |
| HGO (343°-524° C.) yield, wt-% feed | 29.41 | 26.52 |
| Pitch (524° C.+) yield, wt-% feed | 38.01 | 27.30 |
| TIOR, wt-% | 0.92 | 5.30 |
| XRD Mesophase, wt-% | 0.00 | 0.00 |

Greater concentrations of molybdenum can lead to greater conversion to lighter products and TIOR.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for converting heavy hydrocarbon feed into lighter hydrocarbon products comprising:

mixing said heavy hydrocarbon feed with hydrogen and catalyst particles comprising molybdenum supported on a base comprising boehmite or pseudo-boehmite alumina to form a heavy hydrocarbon slurry;

hydrocracking hydrocarbons in said heavy hydrocarbon slurry in the presence of hydrogen in a hydrocracking reactor to produce a hydrocracked slurry product comprising lighter hydrocarbon products; and withdrawing said hydrocracked slurry product from said hydrocracking reactor.

2. The process of claim 1 wherein said base comprises about 2 to about 45 wt-% iron oxide and about 20 to about 98 wt-% alumina on a non-volatile basis.

3. The process of claim 1 further comprising separating said catalyst from said hydrocracked slurry product and recycling said separated catalyst back to the mixing step.

4. The process of claim 1 wherein no more than about 7 wt-% metal is supported on said base.

5. The process of claim 4 wherein no more than about 6 wt-% molybdenum is supported on said base.

6. The process of claim 1 wherein no more than about 6 wt-% molybdenum is supported on said base.

7. The process of claim 1 consisting essentially of only molybdenum supported on said base.

* * * * *